United States Patent [19]

Monni

[11] Patent Number: 4,973,245

[45] Date of Patent: Nov. 27, 1990

[54] METHOD FOR COOLING A KILN FURNACE

[75] Inventor: Veikko A. Monni, Espoo, Finland

[73] Assignee: Outokumpu Oy, Helsinki, Finland

[21] Appl. No.: 368,129

[22] Filed: Jun. 16, 1989

Related U.S. Application Data

[63] Continuation of Ser. No. 229,829, Aug. 8, 1988, abandoned.

[30] Foreign Application Priority Data

Aug. 26, 1987 [FI] Finland ..... 873688

[51] Int. Cl.[5] ..... F27D 15/02; F27B 7/00

[52] U.S. Cl. ..... 432/77; 432/103; 432/116

[58] Field of Search ..... 432/103, 116, 77

[56] References Cited

U.S. PATENT DOCUMENTS

| | | | |
|---|---|---|---|
| 939,817 | 11/1909 | Edison | 432/116 |
| 1,690,820 | 11/1928 | Homsey | 432/116 |
| 1,698,313 | 1/1929 | Lerther | 432/116 |
| 3,034,776 | 5/1962 | Hennenberger et al. | 432/116 |
| 4,212,630 | 7/1980 | Vorobeichikov et al. | 432/80 |
| 4,391,583 | 7/1983 | Serbent et al. | 432/77 |

FOREIGN PATENT DOCUMENTS 1079990 3/1984 U.S.S.R. .

*Primary Examiner*—Henry C. Yuen

*Attorney, Agent, or Firm*—Dellett, Smith-Hill and Bedell

[57] ABSTRACT

The invention relates to the cooling of a rotary kiln with a liquid cooling agent. According to the invention, the cooling agent is distributed to form an essentially even liquid blanket above the rotary kiln (1). In order to achieve this, a number of baffle plates (6) and/or nozzle pipes (9) is arranged at an equal height with respect to the surface of the rotary kiln (1).

7 Claims, 1 Drawing Sheet

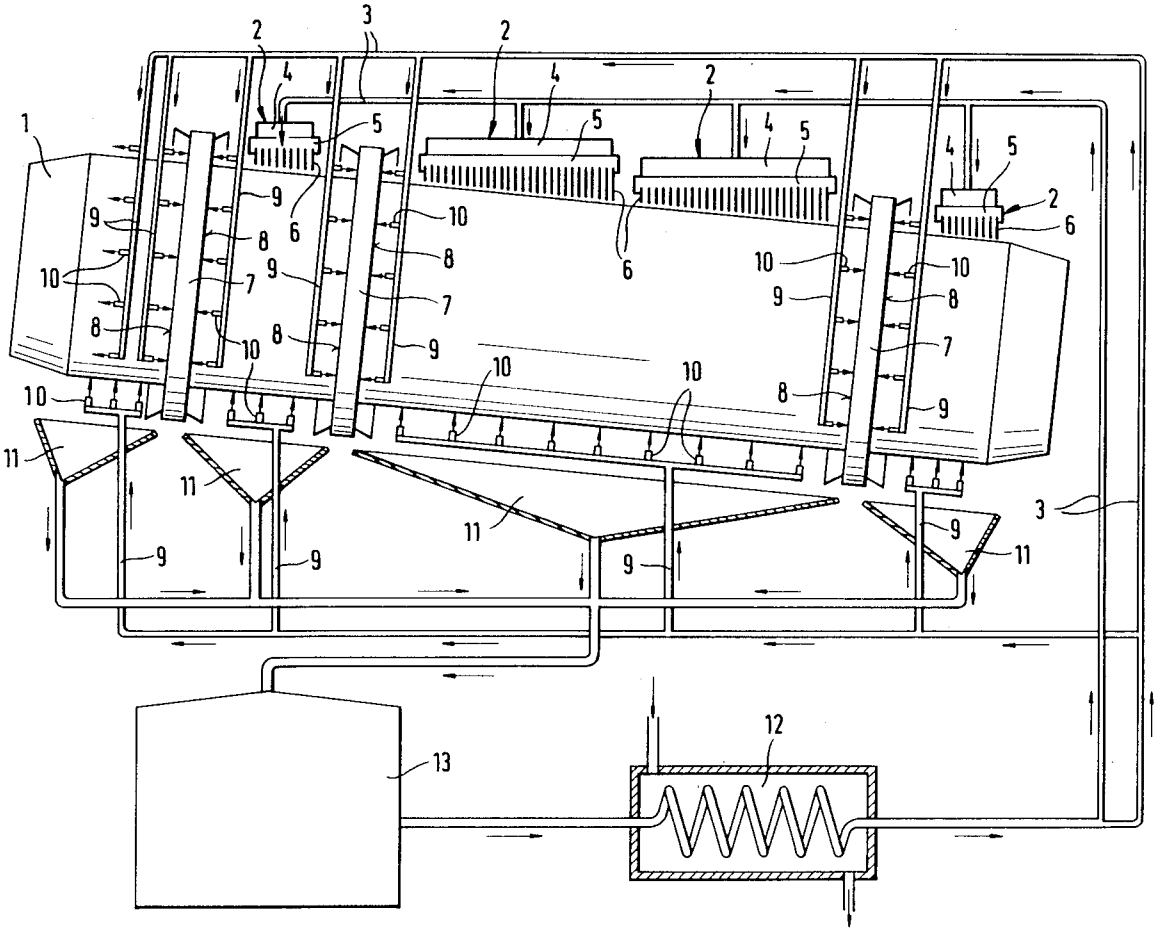
1
2
3
4
5
6
7
8
9
10
11
12
13

METHOD FOR COOLING A KILN FURNACE

This is a continuation of application Ser. No. 07/229,829 filed Aug. 8, 1988 and now abandoned.

The invention relates to a method for cooling a rotary kiln furnace with a liquid cooling agent.

The shell of rotary kiln is usually cooled off with air by intermediation of free convection, or by means of forced convection. The bricklining in these furnaces tends to wear, so that it has to be replaced once or twice a year. The use of the furnace must normally be interrupted when the bricklining is so worn that the temperature of the external structures, i.e. the shell and its support frame, rises too high.

In the prior art, the shell of a rotary kiln has also been cooled with water, as for instance in the rotary kiln of the SU inventor's certificate No. 1,079,990, around which there is installed a particular hood for recovering and utilizing the heat which is radiated from the furnace shell. Moreover, the furnace shell is provided with a metallic cooling water distributor, which distributes the cooling water to different spots on the shell. The cooling water discharged from the furnace surface is collected in the collecting bin placed below the kiln furnace. According to the SU inventor's certificate No. 1,079,990, the surface must be shaped in a specific fashion in order to make the cooling water spread evenly over the whole of the furnace surface. Consequently this sets new requirements for the structure of the rotary kiln which increases for instance the production and running expenses of the furnace.

The object of the present invention is to eliminate some of the drawbacks of the prior art and to achieve an improved and more economical method for cooling a rotary kiln, where an essentially even temperature is created on the furnace surface, and the bricklining of the furnace is effectively cooled off.

According to the invention, a liquid cooling agent, such as water, is conducted onto the surface of a rotary kiln via a distributing member so that blanket formed by the cooling agent is made essentially even, in which case the amount of splashing is also minimized. The flowing of the cooling agent from the distributing member onto the surface of the rotary kiln is adjusted to be advantageous by means of the height of the distributing member and by means of adjusting the inclination of the guide members provided therein.

Owing to the even blanket of cooling agent created according to the invention, an essentially effective heat transmission is achieved between the surface and casing of the rotary kiln, so that the cooling agent essentially gathers heat. The heated cooling agent is collected into a collecting bin placed underneath the rotary kiln and pumped through a heat exchanger, so that the cooling agent is advantageously cooled off and can be recirculated to form a new cooling blanket on the surface of the rotary kiln.

In the method of the invention, the cooling agent is fed onto the surface of an essentially operated and rotary kiln furnace by bleeding with a distributor. Those elements in the structure of the rotary kiln, such as the surfaces of the support and/or rotation frames which are essentially vertical with respect to the surface of the rotary kiln, onto which elements the cooling agent cannot be bled, are cooled by means of nozzles placed in an advantageous position in relation to them.

By conducting the cooling agent essentially throughout the whole surface of the rotary kiln, the temperature on the surface of the rotary kiln is rendered essentially even. Thus the internal bricklining of the rotary kiln is also cooled effectively at various spots of the furnace, which in part slows down the wearing of the internal bricklining of the furnace.

The cooling can be made more effective by creating circumstances for the evaporation of the liquid cooling agent from the cooled surface of the rotary kiln. An increase in this kind of cooling effect is produced for instance by allowing the evaporation of the cooling agent into the air surrounded the rotary kiln.

The invention is explained in more detail with reference to the appended drawing, which is a side-view illustration of a preferred embodiment of the invention.

According to the drawing, above a rotary kiln 1 there is arranged a distributor 2 for water used as the cooling agent, by means of which distributor 2 the water is supplied evenly on the surface of the rotary kiln. The water is conducted, along the pipework 3, to the top part 4 of the distributor, and further by means of adjustable baffle plates 6 provided in the bottom part 5 of the distributor, onto the surface of the rotary kiln 1. In order to distribute water onto the walls 8 of the support and rotation frames 7, which walls 8 are essentially vertical with respect to the surface of the rotary kiln, there are installed pipes 9 at an essentially equal height with respect the surface of the rotary kiln to serve as water distributing members, which pipes 9 are provided with nozzles 10 arranged at essentially equal intervals in order to direct the water spray onto the desired part of the surface. Respective pipes 9 provided with nozzles 10 can also be placed in other parts of the surface of the rotary kiln, if the flowing of the water, essentially based on the gravitational force, is not sufficient or is downright impossible. Therefore the enclosed drawing also illustrates pipes 9 provided with nozzles which are installed underneath the rotary kiln 1. Via the nozzles 10, the water is conducted onto the part of the furnace surface which must be cooled off essentially vertically.

The water which is distributed on the surface of the rotary kiln 1 and been heated there by the hot surface, is collected in the collecting bins 11 placed below the rotary kiln 1, from which bins 11 the water is conducted either directly or via the cooling water tank 13 into the heat exchanger 12. In the heat exchanger 12, the heat bound in the water is recovered if so desired, and the thus cooled-off water can be taken back into circulation in the cooling of the rotary kiln 1.

I claim;

1. A method for cooling a rotary kiln, comprising spreading an essentially even blanket of liquid cooling agent over a substantial part of the surface of the kiln by means of a distributing member having baffle plates that are located over the kiln at an essentially uniform distance from the surface of the rotary kiln "using the baffle plates to adjust the flow of the cooling agent, and collecting the cooling agent that has flowed over the rotary kiln and recycling it".

2. A method according to claim 1, comprising adjusting the inclination of the baffle plates with respect to the rotary kiln in order to adjust the flow of the cooling agent.

3. A method according to claim 1, further comprising emitting liquid cooling agent over a substantial part of the surface of the kiln by means of nozzles placed at an essentially uniform distance from the surface of the rotary kiln.

4. Kiln apparatus comprising:

a rotary kiln having a substantially cylindrical external surface, a distributing member having baffle plates "that are adjustable in inclination", the distributing member being positioned so that the baffle plates are at an essentially uniform distance from the external surface of the kiln, means for supplying liquid cooling agent to the distributing member for cooling the kiln by spreading an essentially even blanket of liquid cooling agent over a substantial part of the external surface of the "kiln, and nozzles connected to the means for supplying liquid cooling agent, the nozzles being placed at an essentially uniform distance from the external surface of the kiln for emitting liquid cooling agent onto the surface of the kiln".

5. Apparatus according to claim 4, wherein the nozzles are directed in a substantially vertical direction towards the surface of the kiln.

6. Apparatus according to claim 4, comprising means for collecting cooling agent that has flowed over the kiln and recycling it.

7. Kiln apparatus comprising:

a rotary kiln having a substantially cylindrical external surface, nozzles placed at an essentially uniform distance from the external surface of the rotary "kiln directed in a substantially vertical direction towards surface of the kiln,".

means for supplying liquid cooling agent to the nozzles for cooling the kiln by spreading an essentially even blanket of liquid cooling agent over the "kiln, and means for collecting cooling agent that has flowed over the kiln and recycling it".

* * * * *